United States Patent [19]

Linde et al.

[11] Patent Number: 4,675,128

[45] Date of Patent: Jun. 23, 1987

[54] ALKANE SULFONATES AS VISCOSITY REGULATORS

[75] Inventors: Karl-Heinz Linde, Langenfeld; Dietrich Kloetzer, Duesseldorf, both of Fed. Rep. of Germany

[73] Assignee: Henkel Kommanditgesellschaft auf Aktien, Duesseldorf, Fed. Rep. of Germany

[21] Appl. No.: 811,127

[22] Filed: Dec. 18, 1985

[30] Foreign Application Priority Data

Dec. 31, 1984 [DE] Fed. Rep. of Germany ..... 3447859

[51] Int. Cl.[4] ..... C11D 1/12

[52] U.S. Cl. ..... 252/549; 252/530; 252/532; 252/533; 252/535; 252/538; 252/552; 252/554; 252/557; 252/DIG. 4; 252/DIG. 14

[58] Field of Search ..... 252/530, 532, 533, 535, 252/538, 549, 552, 554, 557, DIG. 4, DIG. 14

[56] References Cited

U.S. PATENT DOCUMENTS

| | | | |
|---|---|---|---|
| 3,527,707 | 9/1970 | McAteer et al. | 252/554 |
| 3,676,374 | 7/1972 | Zaki et al. | 252/535 |
| 3,741,913 | 6/1973 | Waag et al. | 252/554 |
| 3,893,955 | 7/1975 | Hewitt et al. | 252/551 |
| 3,899,448 | 8/1975 | Messenger et al. | 252/551 |
| 4,239,641 | 12/1980 | Perner et al. | 252/142 |
| 4,384,978 | 5/1983 | Ploog et al. | 252/353 |
| 4,495,092 | 1/1985 | Schmid et al. | 252/538 |

FOREIGN PATENT DOCUMENTS

| | | |
|---|---|---|
| 79904 | 5/1978 | Japan . |
| 64209 | 6/1978 | Japan . |
| 1437089 | 5/1976 | United Kingdom . |

*Primary Examiner*—Paul Lieberman
*Assistant Examiner*—Hoa Van Le
*Attorney, Agent, or Firm*—Ernest G. Szoke; Henry E. Millson, Jr.; Real J. Grandmaison

[57] ABSTRACT

Alkali metal alkane sulfonates containing on averge 11 to 21 carbon atoms are used as viscosity regulators for aqueous, highly concentrated commercial anionic surfactant concentrates, more especially for α-sulfofatty acid ester salt concentrates containing at least 30% by weight of α-sulfofatty acid ester salt. The viscosity regulators are used in quantities of from 0.5 to 10% by weight, based on the surfactant content, so that the concentrates have a viscosity at 40° C. of at most 10,000 mPas.

16 Claims, No Drawings

ALKANE SULFONATES AS VISCOSITY REGULATORS

BACKGROUND OF THE INVENTION

1. Field of the Invention

The present invention relates to alkane sulfonates useful as viscosity regulators for highly viscous anionic surfactant concentrates.

2. Description of Related Art

The starting materials used in the commercial manufacture of powder-form or granular detergents and cleaners by the hot-spraying process are aqueous suspensions or slurries which contain a high percentage of or even all the detergent ingredients. It is important for economic reasons that these slurries should be rich in detergent ingredients with very little liquid ballast. Accordingly, the smallest possible quantity of water is used for preparing the slurries. However, limits are imposed on the level of concentration by the highest possible viscosity at which the slurries can still just be processed.

An essential constituent of most detergents and cleaners are anionic surfactants which, in the preparation of the detergent slurries, are generally used in the form of their alkali metal or ammonium salts concentrated to pastes. In the case of the sodium salts of α-sulfotallow fatty acid methyl ester for example, the surfactant content of the paste-form concentrates is of the order of 30% by weight. Pastes of higher surfactant content can only be processed with considerable difficulty, if at all. One feature of the rheological behavior of these anionic surfactant concentrates is that they do not react to the addition of water by a reduction in viscosity, but instead with an increase in viscosity to a gel-like state which presents the processor with further problems, for example in the blockage of valves and pipes or in the fact that the gelatinous lumps formed can only be redissolved after mechanical size reduction.

Various proposals have already been put forward with a view to solving these problems. Thus, U.S. Pat. No. 3,893,955, for example, describes the salts of certain carboxylic acids, more especially salts of hydroxy carboxylic acids, as viscosity regulators. According to U.S. Pat. No. 3,899,448, sulfonated aromatic compounds are suitable for this purpose. British Pat. No. 1,437,089 discloses sulfates or sulfonates of aliphatic, optionally substituted $C_1$–$C_6$ hydrocarbons as viscosity regulators. These publications also mention the addition of lower alcohols as a possibility for reducing viscosity. Other publications describe the addition of the well known hydrotropes, such as for example cumene sulfonate, or of acidic phosphoric acid esters (U.S. Pat. No. 3,741913), polyhydric alcohols, certain carboxylic acids and/or esters of these compounds (U.S. Pat. No. 4,239,641). The use of sulfates of certain polyalkylene ether glycols for improving the flow behavior of anionic surfactant concentrates is known from U.S. Pat. No. 4,384,978.

Some of the additives mentioned in the literature do not work with all surfactant concentrates; some have to be used in high concentrations; while others, such as lower alkanols for example, lower the flash point of the concentrates.

DESCRIPTION OF THE INVENTION

Other than in the operating examples, or where otherwise indicated, all numbers expressing quantities of ingredients or reaction conditions used herein are to be understood as modified in all instances by the term "about".

Accordingly, an object of th present invention is to provide additives for improving the flow behavior of aqueous commercial anionic surfactant concentrates, particularly α-sulfofatty acid ester salt concentrates, so that these concentrates can be processed in even higher concentrations than before, i.e. concentrates of higher solids content can be used at a viscosity still suitable for processing. Moreover, the invention also seeks to ensure that highly concentrated anionic surfactant concentrates, particularly α-sulfofatty acid ester salt concentrates, do not undergo any increase in viscosity on dilution with water.

According to the invention, this object is achieved by the use of alkali metal alkane sulfonates containing on average from 11 to 21 carbon atoms as viscosity regulators for aqueous, highly concentrated commercial anionic surfactant concentrates, particularly α-sulfofatty acid ester salt concentrates, containing at least 30% by weight of α-sulfofatty acid ester salt. According to the invention, the viscosity regulators are used in quantities of from 0.5 to 10% by weight, based on the surfactant content, so that the concentrates have a viscosity of at most 10,000 mPas at 40° C.

The alkali metal alkane sulfonates used as viscosity regulators in accordance with the invention are known, readily water-soluble compounds which, by virtue of their high wetting, foaming, and detergent power, have long been used as detergent ingredients unaffected by the hardness of water. These compounds are normally produced by sulfochlorination of n-paraffins containing the appropriate number of carbon atoms and subsequent hydrolysis of the alkane sulfochlorides formed with alkali metal hydroxides. Sodium alkane sulfonates are of particular interest for purposes of the invention.

The alkane sulfonates discussed above consist predominantly of salts of alkane monosulfonic acids and, to a lesser extent (approximately 15 to 50% by weight of the washing-active substance), of di- and polysulfonates. The monosulfonate component in turn consists mainly of secondary alkane sulfonates of which the sulfonate groups are attached in random distribution to the individual carbon atoms of the alkane chain. The alkane sulfonates commercially available at the present time are obtained from relatively narrow n-paraffin cuts, for example from fractions having an average chain length of 13, 15 and 20 to 21 carbon atoms. The alkane sulfonates used are produced by methods which largely preclude chlorination of the carbon chain. Corresponding commercial products are available in the form of concentrated solutions, pastes and solid products for use in accordance with the invention. The products of the invention can be used as viscosity regulators either individually or in admixture. Combinations of alkane sulfonates having average chain lengths of 13, 15 and 20 to 21 carbon atoms are of particular value.

Viscosity regulation is a particular problem in the case of concentrates of α-sulfofatty acid ester salts because even concentrates having a surfactant content of more than about 30% by weight are no longer readily processible. If the viscosity problem did not exist, it would be technically possible to produce surfactant concentrates having a surfactant content of up to about 80% by weight. Accordingly, reducing the viscosity of α-sulfofatty acid ester salt concentrates is a particular object of the present invention.

The α-sulfofatty acid ester salt concentrates of which the viscosity can be reduced by the use of alkane sulfonates in accordance with the invention are derived from fatty acids containing from 10 to 20 and preferably from 12 to 18 carbon atoms and from aliphatic alcohols containing from 1 to 10 and preferably from 1 to 4 carbon atoms in the molecule. The sulfo group is introduced either by sulfonation of the fatty acids and subsequent esterification of the carboxyl group with alcohol or by sulfonation of a corresponding fatty acid ester. In either case, esters of sulfofatty acids containing the sulfofatty acid group in the α-position are obtained. The α-sulfofatty acid ester salts are preferably in the form of alkali metal and/or ammonium salts, particularly sodium salts. The salts are produced by neutralization of the acidic esters with the corresponding bases.

Particularly suitable α-sulfofatty acid ester salts are derived from the ethyl ester and, more particularly, the methyl ester of hydrogenated tallow fatty acid, the acid component of the fatty acid esters essentially consisting of saturated $C_{16}$ and $C_{18}$ fatty acids.

The use of alkane sulfonates in accordance with the invention produces a significant improvement in the flow behavior of aqueous anionic surfactant concentrates, particularly α-sulfofatty acid ester salt concentrates, over the entire temperature range in which concentrates of this type are processed. The effect of adding the alkane sulfonates of the invention not only results in the viscosity of the surfactant concentrates being greatly reduced, but also the "hardening" into solid, virtually non-processible masses which the freshly prepared concentrates undergo on cooling and standing at normal temperature in the absence of viscosity regulators, particularly in the case of long-chain α-sulfofatty acid ester salts, is completely avoided. The skeleton formation responsible for the solidification of the mixtures is prevented in the surfactant concentrates containing the alkane sulfonates used in accordance with the invention. These surfactant concentrates are free-flowing and pumpable pastes, even at normal temperatures.

The invention will be better understood from the following examples which are given for purposes of illustration and not of limitation.

EXAMPLES

Examples 1 to 4

To various samples of a commercially produced concentrate of the sodium salt of an α-sulfo-$C_{16}/C_{18}$-fatty acid methyl ester (with approximately 60% by weight of palmitic acid and approximately 40% by weight of stearic acid in the fatty acid methyl ester used as starting material) containing approximately 33% by weight of washing-active substance (WAS) were added different quantities of a sodium alkane sulfonate having an average chain length of $C_{15}$ and an average molecular weight of approximately 330 in the form of a 68% by weight aqueous solution in which the di- and polysulfonate component made up approx. 15% by weight of the washing-active substance (sulfonate A) and a sodium alkane sulfonate having an average chain length of $C_{20}$–$C_{21}$ and an average molecular weight of approx. 400 in the form of a 65% by weight aqueous solution in which the di- and polysulfonate component made up approx. 42 to 50% by weight of the washing-active substance (sulfonate B).

The viscosity of the samples at 40° C. was then determined using a Hoppler viscosimeter. The results obtained are shown in the following Table.

TABLE I

Viscosity reduction of sodium-α-sulfo-$C_{16}/C_{18}$-fatty acid ester concentrate (approx. 33% by weight of WAS) at 40° C.

| Example No. | Addition PBW/100 PBW surfactant solution: Sulfonate A | Sulfonate B | Viscosity mPas |
|---|---|---|---|
| 1 | 0 | 0 | 159,840 |
| 2 | 0.7 | 1.3 | 1,074 |
| 3 | 1.4 | 2.0 | 2,202 |
| 4 | 1.8 | 1.6 | 130 |

With surfactant solutions of higher concentration, the addition of viscosity regulator may be increased to achieve the desired reduction in viscosity. Also, the reduction in viscosity achieved with a certain quantity of viscosity regulator increases with increasing temperature. However, it is generally not advisable to increase the working temperature due to the greater energy consumption this would involve.

Examples 5 to 8

To various samples of a commercially produced concentrate of the sodium salt of an α-sulfo-$C_{16}/C_{18}$-fatty acid methyl ester (with approximately 50% by weight of palmitic acid and approximately 50% by weight of stearic acid in the fatty acid methyl ester used as starting material) containing approximately 31% by weight of washing-active substance were added different quantities of the sodium alkane sulfonates described as sulfonate A and sulfonate B in Examples 1 to 4, after which the viscosities of the samples at 40° C. were determined using a Hoppler viscosimeter. The results obtained are shown in Table II below.

TABLE II

Viscosity reduction of sodium-α-sulfo-$C_{16}/C_{18}$-fatty acid ester concentrate (approx. 31% by weight WAS) at 40° C.

| Example No. | Addition PBW/100 PBW surfactant solution: Sulfonate A | Sulfonate B | Viscosity mPas |
|---|---|---|---|
| 5 | 0 | 0 | 320,000 |
| 6 | 1.4 | 1.3 | 3,503 |
| 7 | 1.4 | 1.6 | 1,118 |
| 8 | 1.8 | 1.6 | 664 |

The sample of Example 6 was stored for 7 days at room temperature. Thereafter, a viscosity of 3220 mPas was measured at 23° C.

Examples 9 to 12

To various samples of a commercially produced concentrate of the sodium salt of an α-sulfo-$C_{16}/C_{18}$-fatty acid methyl ester (with approximately 30% by weight of palmitic acid and approximately 70% by weight of stearic acid in the fatty acid methyl ester used as starting material) containing approximately 29% by weight of washing-active substance were added different quantities of the sodium alkane sulfonates described as sulfonate A and sulfonate B in Examples 1 to 4, after which the viscosity of the samples at 40° C. was determined using a Hoppler viscosimeter. The results obtained are shown in Table III below.

TABLE III

Viscosity reduction of sodium-α-sulfo-$C_{16}/C_{18}$-fatty acid ester concentrate (approx. 29% by weight WAS) at 40° C.

| Example No. | Addition PBW/100 PBW surfactant solution | | Viscosity mPas |
|---|---|---|---|
| | Sulfonate A | Sulfonate B | |
| 9 | 0 | 0 | 270,520 |
| 10 | 1.4 | 2.0 | 4,662 |
| 11 | 1.8 | 2.6 | 638 |
| 12 | 2.5 | 2.9 | 311 |

Examples 13 to 20

To various samples of a commercially produced concentrate of the sodium salt of an α-sulfo-$C_{16}/C_{18}$-fatty acid methyl ester (with approximately 30% by weight of palmitic acid and 70% by weight of stearic acid in the fatty acid methyl ester used as starting material containing approximately 33% by weight of washing-active substance were added different quantities of the sodium alkane sulfonates described as sulfonate A and sulfonate B in Examples 1 to 4 and of a sodium alkane sulfonate having an average chain length of $C_{13}$ and an average molecular weight of approximately 350 in the form of a 68% by weight aqueous solution in which the di- and polysulfonate component made up approximately 15% by weight of the washing-active substance (sulfonate C).

The viscosity of the samples at 40° C. was then determined using a Hoppler Viscosimeter. The results obtained are shown in Table IV below.

TABLE IV

Viscosity reduction of sodium-α-sulfo-$C_{16}/C_{18}$-fatty acid ester concentrate (approx. 33% by weight WAS) at 40° C.

| Example No. | Addition PBW/100 PBW surfactant solution | | | Viscosity mPas |
|---|---|---|---|---|
| | Sulfonate A | Sulfonate B | Sulfonate C | |
| 13 | 0 | 0 | 0 | 200,000 |
| 14 | 2 | — | 2 | 8,508 |
| 15 | 1.5 | 1.5 | — | 8,018 |
| 16 | — | 2 | 2 | 1,494 |
| 17 | 1 | 1 | 1 | 5,460 |
| 18 | 1.3 | 1.3 | 1.3 | 3,601 |
| 19 | 1 | 3 | 1 | 301 |
| 20 | 1.5 | 2 | 1.5 | 1,150 |

What is claimed is:

1. An aqueous anionic surfactant concentrate comprising:

A. at least about 30% by weight of an α-sulfofatty acid ester salt; and

B. at least one alkali metal alkane sulfonate having on average from 11 to 21 carbon atoms which is present in an amount sufficient to reduce the viscosity of the concentrate to no greater than 10,000 mPas at 40° C.

2. A concentrate of claim 1 wherein component B is present in an amount of from about 0.5 to about 10% by weight, based on the weight of component A.

3. A concentrate of claim 1 wherein the α-sulfofatty acid ester salt is an alkali metal or ammonium salt of α-sulfotallow fatty acid methyl ester.

4. A concentrate of claim 1 wherein component B is a sodium alkane sulfonate.

5. A concentrate of claim 1 wherein component B contains from about 15 to about 50% by weight of disulfonates and/or polysulfonates.

6. A concentrate of claim 1 wherein component B comprises salts of alkane monosulfonic acids.

7. A concentrate of claim 1 wherein said alkane sulfonate comprises a combination of alkane sulfonates having average chain lengths of 13, 15 and 20 to 21 carbon atoms.

8. A concentrate of claim 1 wherein component A is derived from fatty acids containing from 10 to 20 carbon atoms and from aliphatic alcohols containing from 1 to 10 carbon atoms in the molecule.

9. A process for reducing the viscosity of an aqueous anionic surfactant concentrate comprising at least about 30% by weight of an α-sulfofatty acid ester salt; said process comprising adding to said concentrate at least one alkali metal alkane sulfonate having on average from 11 to 21 carbon atoms in an amount sufficient to reduce the viscosity of said concentrate to no greater than 10,000 mPas at 40° C.

10. A process of claim 9 wherein the viscosity reducing amount is from about 0.5 to about 10% by weight, based on the weight of anionic surfactant.

11. A process of claim 9 wherein said α-sulfofatty acid ester salt is an alkali metal or ammonium salt of α-sulfotallow fatty acid methyl ester.

12. A process of claim 9 wherein said alkane sulfonate comprises sodium alkane sulfonate.

13. A procss of claim 9 wherein said alkane sulfonate contains from about 15 to about 50% by weight of disulfonates and/or polysulfonates.

14. A process of claim 9 wherein said alkane sulfonate comprises salts of alkane monosulfonic acid.

15. A process of claim 9 wherein said alkane sulfonate comprises a combination of alkane sulfonates having average chain lengths of 13, 15 and 20 to 21 carbon atoms.

16. A process of claim 9 wherein said α-sulfofatty acid ester salt is derived from fatty acids containing from 10 to 20 carbon atoms and from aliphatic alcohols containing from 1 to 10 carbon atoms in the molecule.

* * * * *